US006585396B1

(12) United States Patent
Verfuerth

(10) Patent No.: US 6,585,396 B1
(45) Date of Patent: Jul. 1, 2003

(54) FLUORESCENT HANGING LIGHT FIXTURE

(76) Inventor: Neal R. Verfuerth, 642 Western Ave., Random Lake, WI (US) 53075

( * ) Notice: Subject to any disclaimer, the term of this patent is extended or adjusted under 35 U.S.C. 154(b) by 0 days.

(21) Appl. No.: 09/870,976

(22) Filed: Jun. 1, 2001

(51) Int. Cl.[7] ..... F21V 1/00
(52) U.S. Cl. ..... 362/260; 362/221; 362/225; 362/241
(58) Field of Search ..... 362/260, 217, 362/221, 222, 225, 241, 247

(56) References Cited

U.S. PATENT DOCUMENTS

| | | | | | |
|---|---|---|---|---|---|
| 2,619,583 | A | | 11/1952 | Baumgartner | 362/221 |
| 3,247,368 | A | | 4/1966 | McHugh | 362/228 |
| 4,435,744 | A | * | 3/1984 | Russo | 362/260 |
| 4,674,015 | A | | 6/1987 | Smith | 362/217 |
| 4,814,954 | A | | 3/1989 | Spitz | 362/217 |
| 4,928,209 | A | | 5/1990 | Rodin | 362/217 |
| 5,062,030 | A | | 10/1991 | Figueroa | 362/346 |
| 5,111,370 | A | * | 5/1992 | Clark | 362/260 |
| 5,192,129 | A | | 3/1993 | Figueroa | 362/346 |

* cited by examiner

*Primary Examiner*—Stephen Husar
(74) *Attorney, Agent, or Firm*—Robert T. Johnson

(57) ABSTRACT

Disclosure is made of a fluorescent light fixture having longitudinal light reflectors and each end of the light reflectors attached to socket mount/wire raceway arms attached to ends of ballast channel assembly and sockets for fluorescent light tubes mounted on socket mount/wire raceway arms at each end of the longitudinal light reflectors on the concave side, and fluorescent light tubes inserted into fluorescent light tube sockets on the concave side of the light reflectors. The geometry of the cross section parabola of the reflectors is identified.

5 Claims, 8 Drawing Sheets

Figure 1:
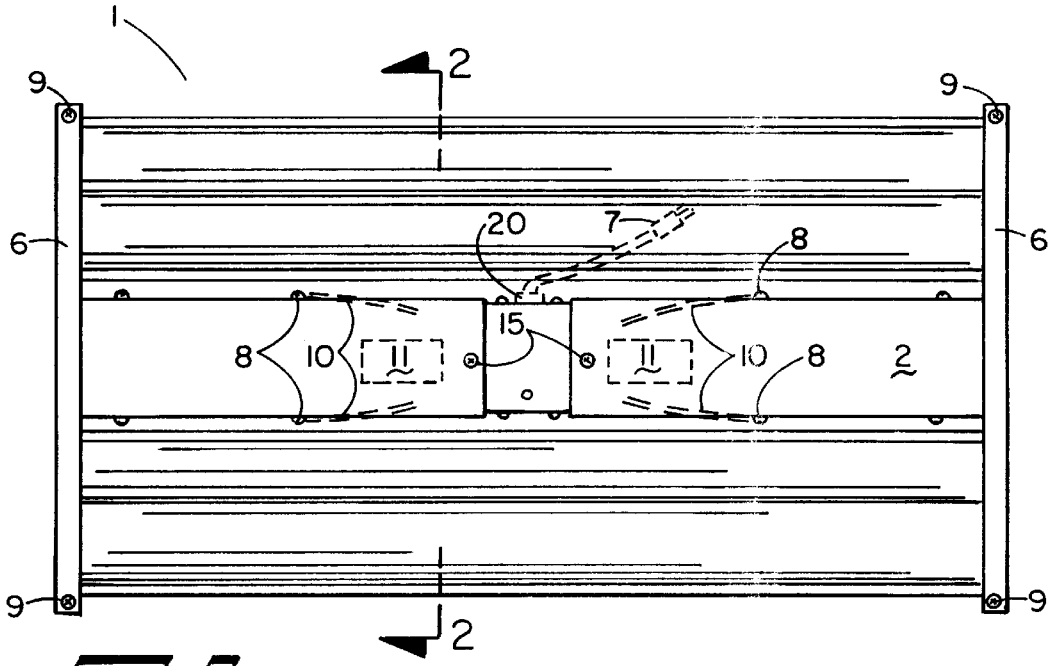

W = 2 x D
S = 0.5xD
d = .375xD
R' = .875xD
ARC=160° d = .375xD
d' = 3.25xD
C = 0.5xD
ARC=120°

FLUORESCENT HANGING LIGHT FIXTURE

BACKGROUND OF THE INVENTION

Fluorescent hanging light fixtures, up to the present have a shroud fastened to the ceiling, or are mounted in recessed openings in the ceiling, and the ballast is mounted in the concave side of the shroud. This present invention discloses a hangable fluorescent light fixture with fluorescent light tubes, mounted on the concave side of longitudinal reflectors and the longitudinal reflectors attached to socket mount/wire raceway arms of the fluorescent light fixture frame.

SUMMARY OF THE INVENTION

Disclosure is made of a fluorescent light fixture 1, having longitudinal light reflectors 4, and each end of the light reflectors 4, attached to socket mount/wire raceway arms 6, attached to ends of ballast channel assembly 2, and sockets 5, for fluorescent light tubes 3 mounted on socket mount/wire raceway arms 6 at each end of the longitudinal light reflectors 4 on the concave side, and fluorescent light tubes 3, inserted into fluorescent light tube sockets 5 on the concave side 4" of the light reflectors 4, and the light reflectors 4 having a parabolic shape in cross section, to control down light intensity.

An object of this invention of a fluorescent light fixture assembly 1 including a fluorescent light fixture frame 12 a ballast channel assembly 2 and socket mount/wire raceway arms 6, attached to the ballast channel assembly 2 and fluorescent light reflectors 4, attached to the socket mount/wire raceway arms 6, and fluorescent fixture tube sockets 5, 5' attached to the socket mount/wire raceway arms 6, and the fluorescent fixture tube sockets 5, 5' located under each end of the fluorescent light reflectors 4, and fluorescent light tubes 3, inserted into the fluorescent fixture tube sockets 5, 5' under the reflectors 4, and an electric power source 7 into the light fixture assembly and a switch on/off 20 mounted on the ballast channel assembly, and the power connected to the ballast 11 components mounted in the ballast channel assembly 2.

Another object is to disclose fluorescent light reflectors of various geometry to better reflect the fluorescent tube light downward.

Another object is to disclose a fluorescent light tube assembly having from one to a plurality of ten fluorescent light tubes aligned parallel side by side in an assembled fluorescent light fixture, and a reflector over each of the fluorescent tube lights.

Another object of this invention is to disclose fluorescent light tube reflectors made of polished sheet metal, or metal coated plastic, or metal coated glass.

PRIOR ART

The following U.S. Patents are cited as prior art.

U.S. Pat. No. 2,619,583 to BAUMGARTNER for LUMINAIRE FOR ELONGATED LAMPS. This patent discloses a housing over the back of the reflectors U.S. Pat. No. 3,247,368 to McHUGH for FLUORESCENT LIGHTING FIXTURE.

This discloses the lights grouped under a hood and does not include individual reflectors.

U.S. Pat. No. 4,674,015 to SMITH for FLUORESCENT LIGHT FIXTURE WITH REMOVABLE BALLAST. Disclosure is made of a plug in ballast on the spine of the fixture.

U.S. Pat. No. 4,814,954 to SPITZ for RIGID LIGHTWEIGHT FLUORESCENT FIXTURE. Disclosure is made of a reflector positioned between double walled end panels, which are connected to one another by a double walled elongated box like structure.

U.S. Pat. No. 4,928,209 to RODIN for LIGHTING APPARATUS. This patent discloses a reflector, having tube hangers one reflector for each pair of tubes, and the reflectors mounted in a cover.

U.S. Pat. No. 5,062,030 to FIGUEROA for CUSTOMIZED LIGHT REFLECTOR.

This patent discloses reflectors mounted in existing fixtures.

U.S. Pat. No. 5,192,129 to FIGUEROA for CUSTOMIZED LIGHT REFLECTOR.

This patent discloses light reflecting planes installed in a lighting fixture.

BRIEF DESCRIPTIONS OF DRAWINGS

FIG. 1—Top plan view of fluorescent light fixture assembly.

Figure 2:
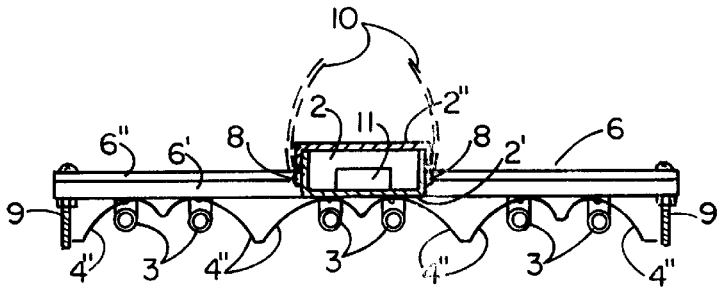

FIG. 2—Cross section of fluorescent light fixture assembly.

Figure 3:
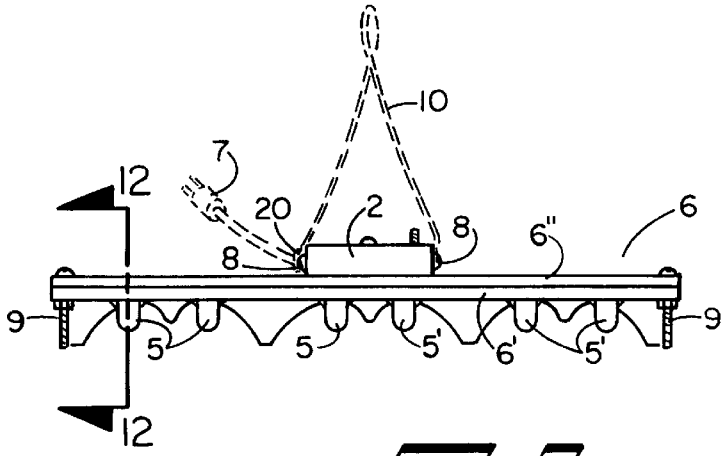

FIG. 3—End elevation view of fluorescent light fixture assembly.

Figure 4:
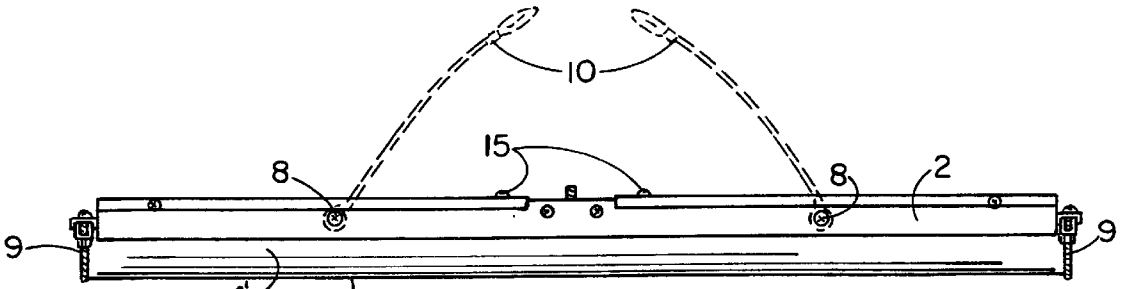

FIG. 4—Front elevation view of fluorescent light fixture assembly.

Figure 5:
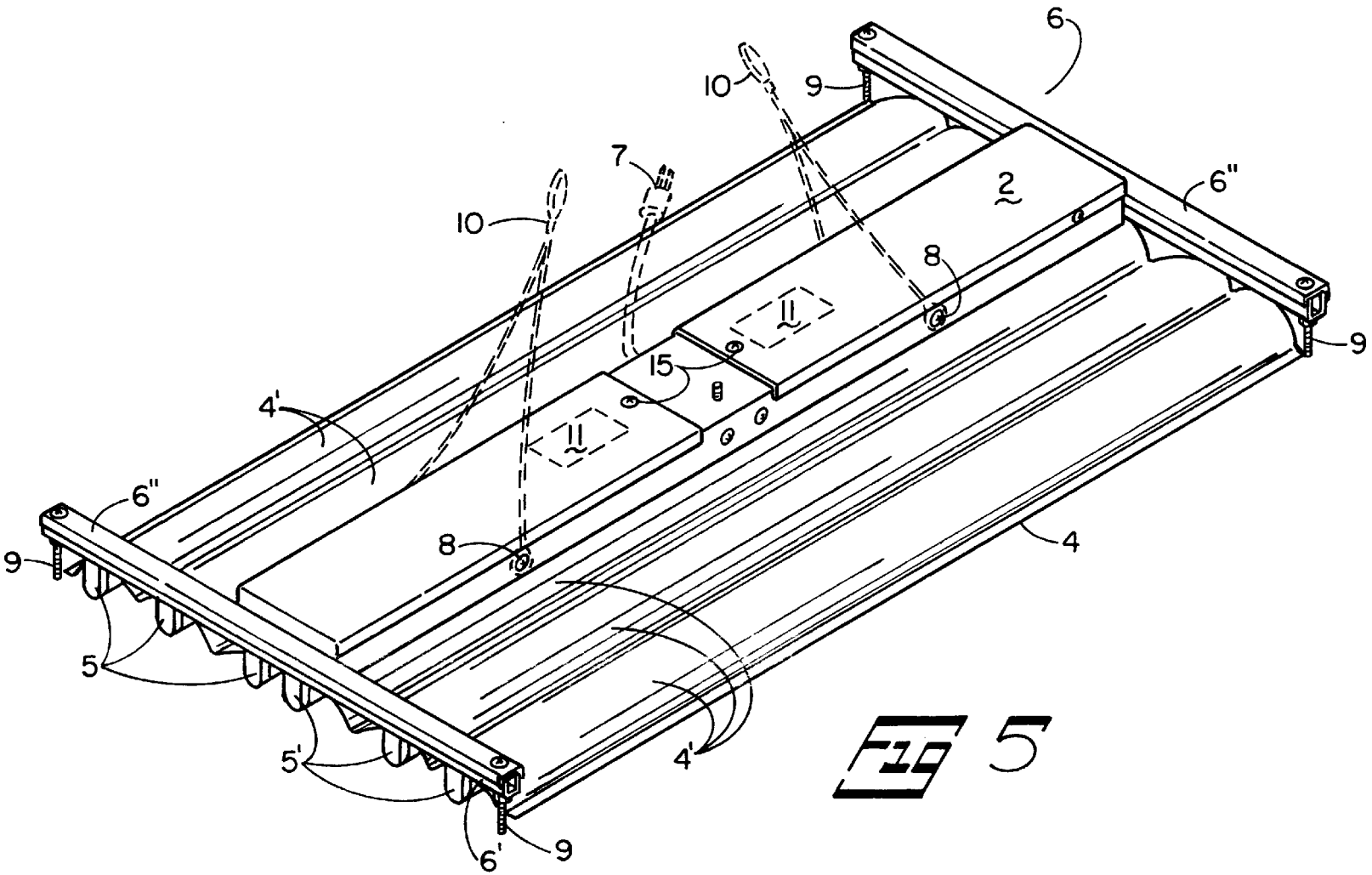

FIG. 5—Perspective view of fluorescent light fixture assembly.

Figure 6:
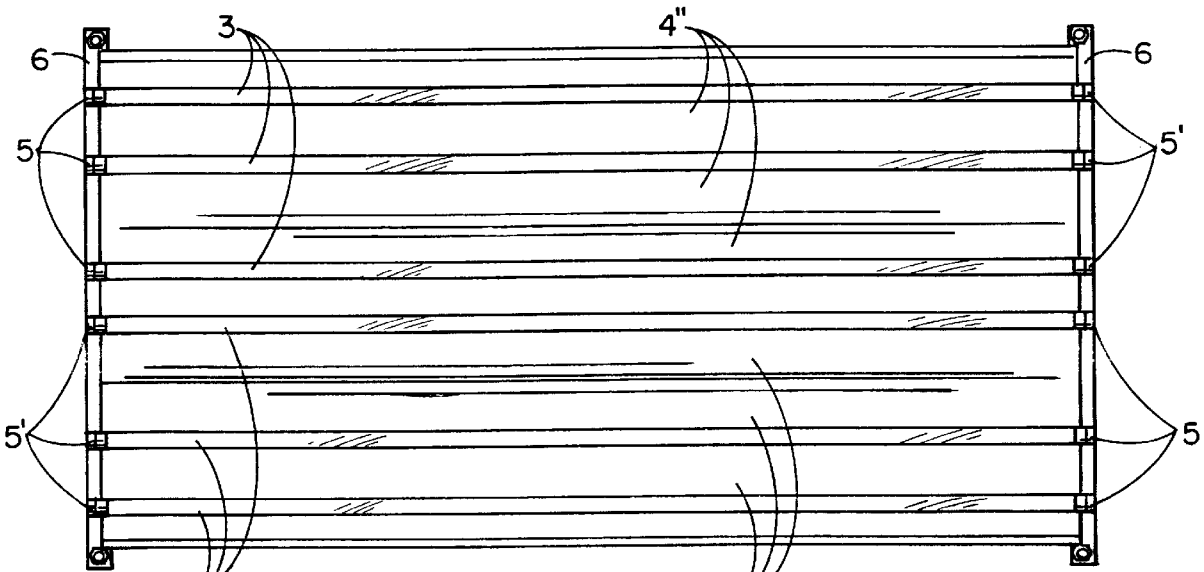

FIG. 6—Bottom plan view of fluorescent light fixture assembly.

Figure 7:
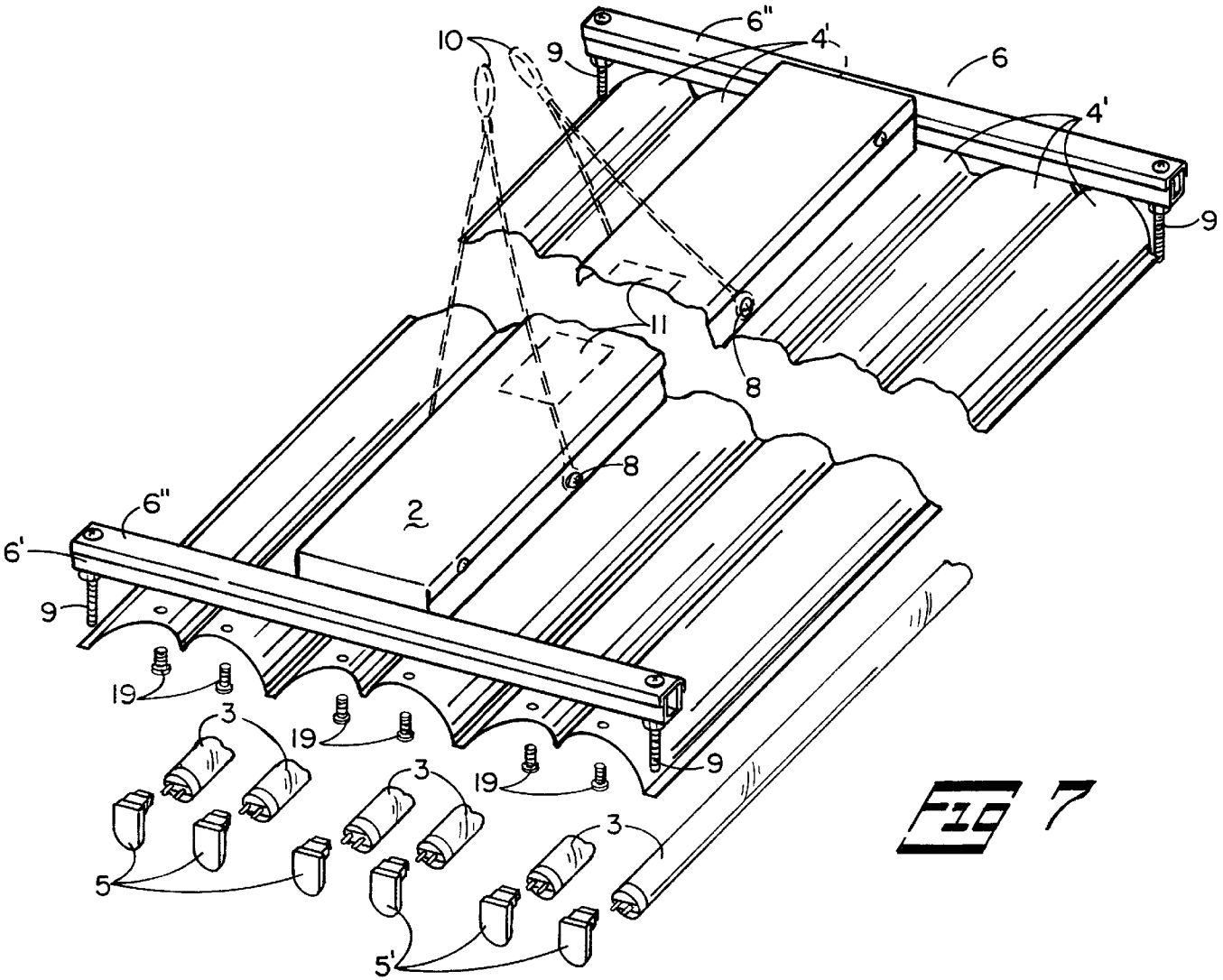

FIG. 7—Perspective exploded view of fluorescent light fixture assembly.

Figures 8, 9:
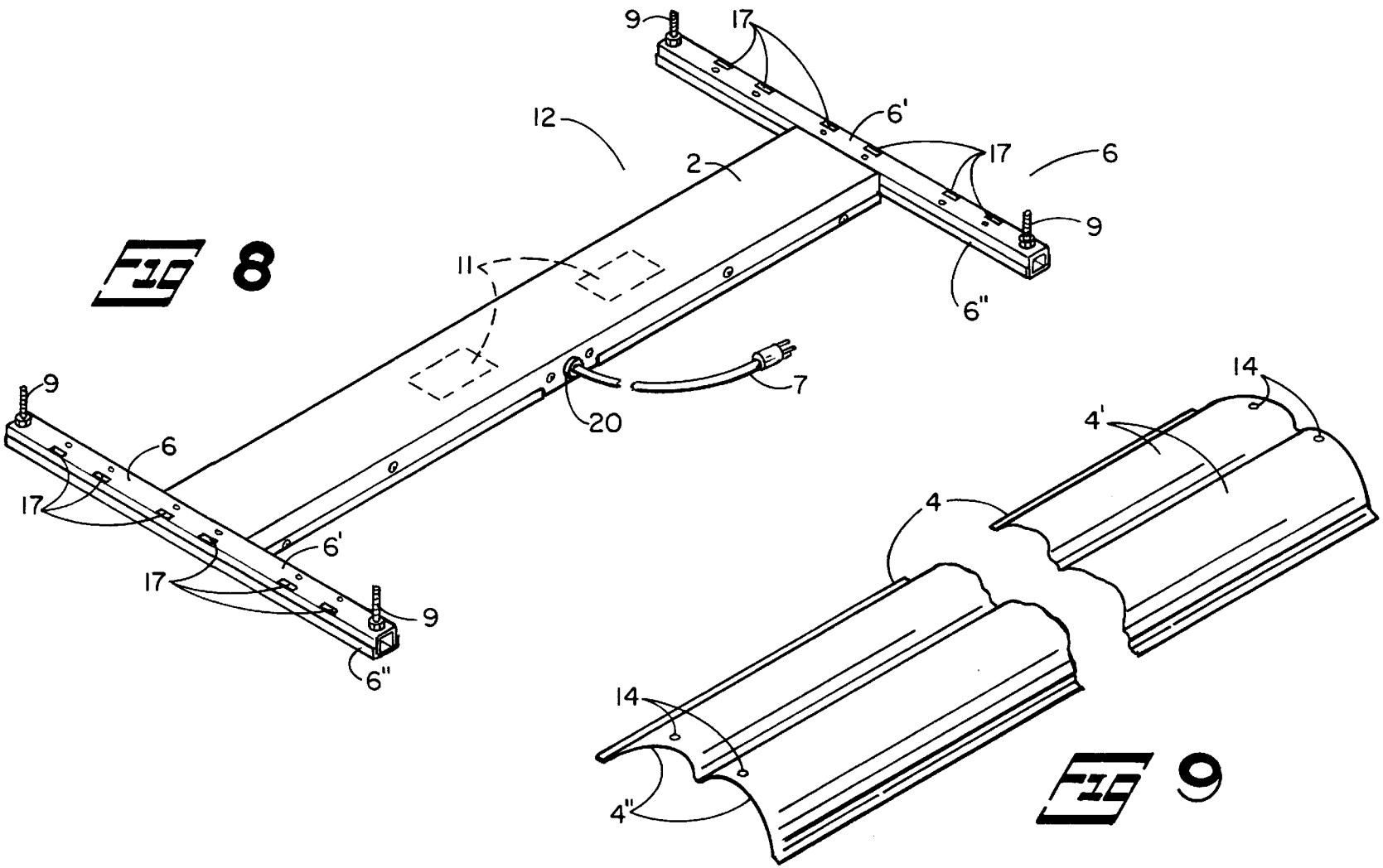

FIG. 8—Fluorescent light fixture frame.

FIG. 9—Perspective view of fluorescent light reflectors.

Figure 10:
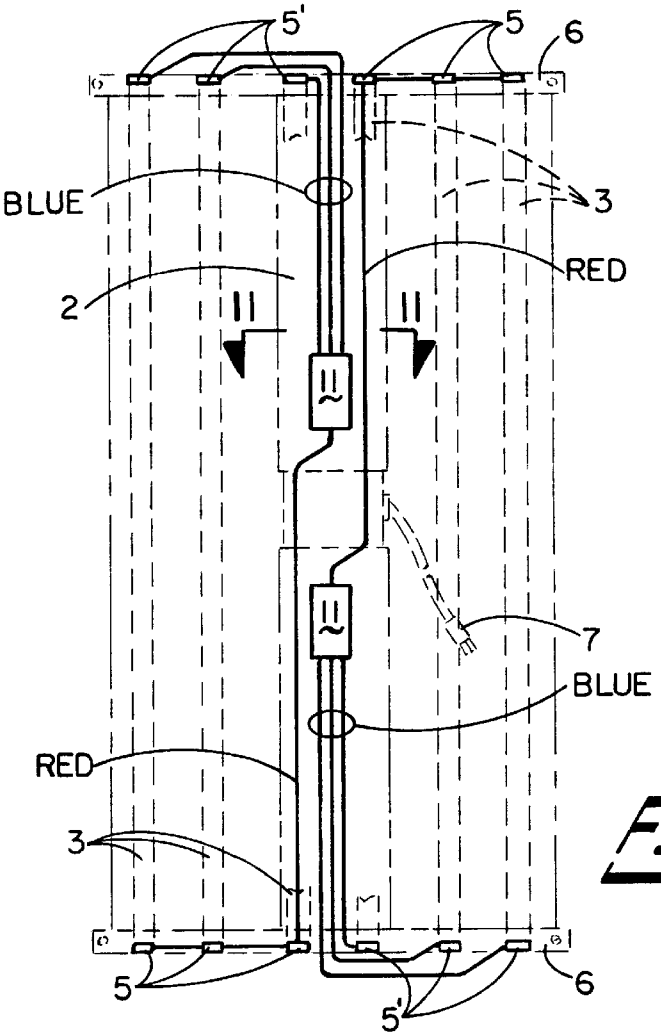

FIG. 10—Wiring diagram of fluorescent light fixture frame.

Figure 11:
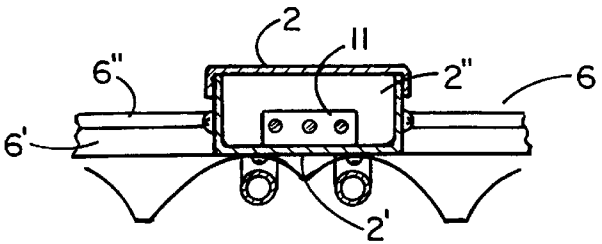

FIG. 11—Cross section of ballast channel.

Figure 12:
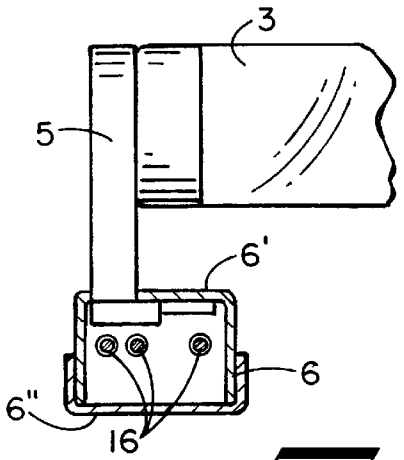

FIG. 12—Cross section of socket mount arm wire raceway

Figure 13:
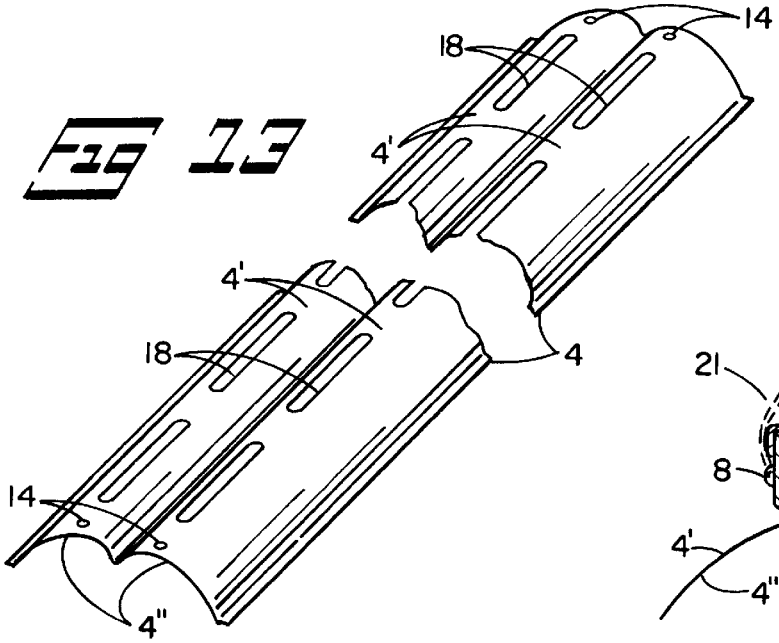

FIG. 13—Reflector segments with slots.

Figure 14:
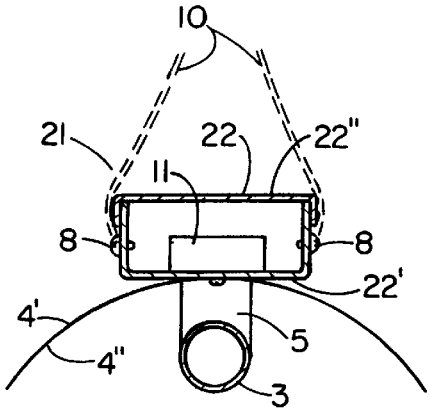

FIG. 14—Cross section of single reflector fixture.

Figure 15:
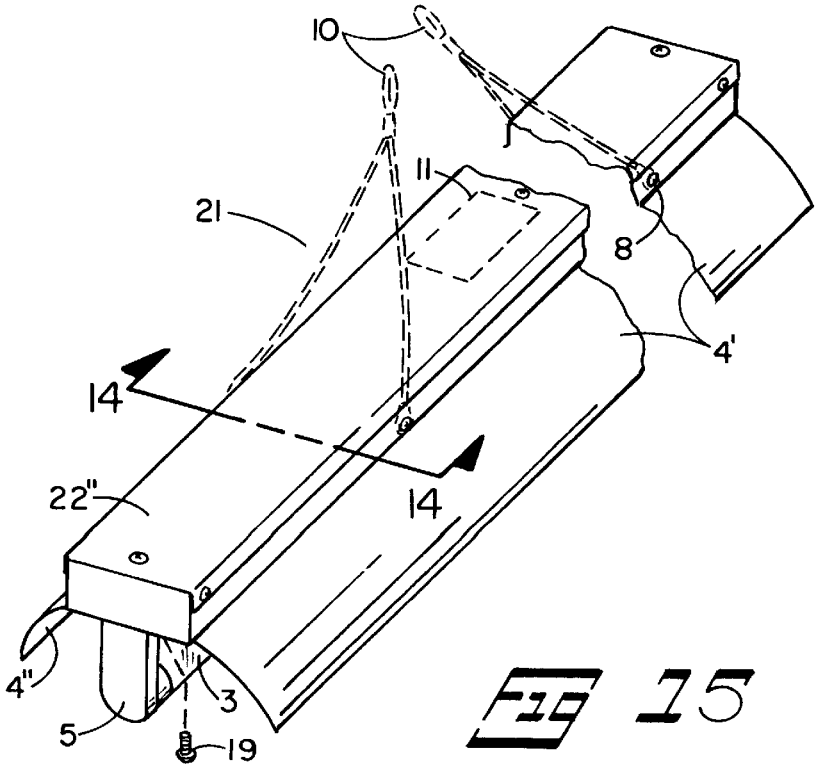

FIG. 15—Perspective view of single reflector light fixture assembly.

Figure 16:
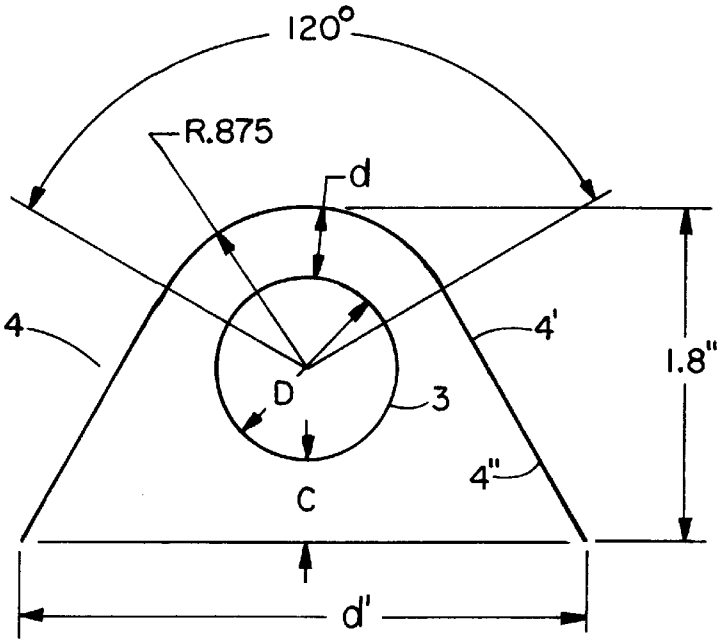

FIG. 16—Cross section view of geometry of fluorescent tube light reflector.

Figure 17:
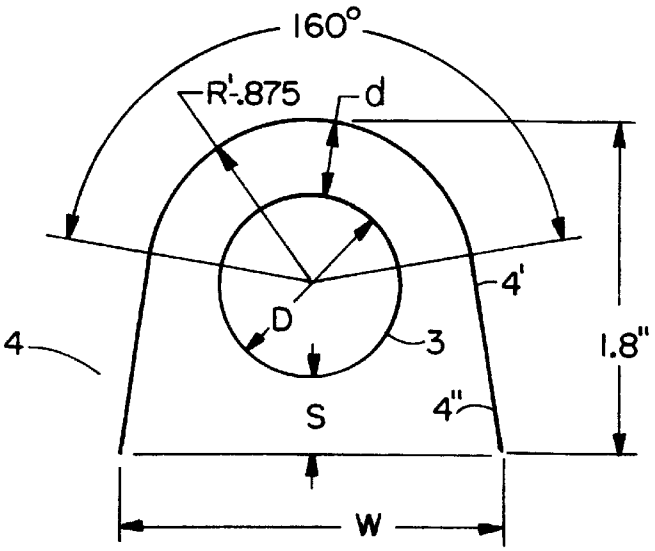

FIG. 17—Cross section view of alternate geometry of fluorescent tube light reflector.

LEGENDS OF DRAWINGS

| LEGEND | DESCRIPTION |
|---|---|
| 1 | Top plan view of assembled fluorescent light fixture. |
| 2 | Ballast channel assembly. |
| 2' | Ballast channel bottom. |
| 2" | Ballast channel cover. |
| 3 | Fluorescent light tubes. |
| 4 | Fluorescent light tube reflectors. |
| 4' | Convex side of reflectors. |
| 4" | Light reflector channels/concave side of reflectors. |

-continued

| LEGEND | DESCRIPTION |
|---|---|
| 5 | Fluorescent fixture tube sockets. |
| 5' | Fluorescent fixture tube sockets, connected in series |
| 6 | Socket mount/wire raceway arms. |
| 6' | Bottom section of channel socket mount/wire raceway arm. |
| 6" | Top cover section of channel socket mount/wire raceway arm. |
| 7 | Electric power source into the light fixture assembly apparatus. |
| 8 | Hanger mounts. |
| 9 | Screw mounts. |
| 10 | Hanger wire/chain. |
| 11 | Ballast. |
| 12 | Fluorescent light fixture frame. |
| 13 | Anchor rivets, bolts or screws for attachment of light reflectors to socket mount arms. |
| 14 | Apertures for fasteners attaching reflectors to socket mount arms. |
| 15 | Fasteners for attaching top of ballast channel to ballast channel bottom. |
| 16 | Wires in arms of fixture frame. |
| 17 | Aperture slots for insertion of snap fit fluorescent light tube sockets. |
| 18 | Slots in reflectors. |
| 19 | Fasteners to attach reflectors to socket mount arms. |
| 20 | Switch on/off. |
| 21 | Single fluorescent light tube fixture. |
| 22 | Ballast channel assembly for single fluorescent light tube |
| 22' | Ballast channel bottom for single fluorescent light tube. |
| 22" | Ballast channel cover for single fluorescent light tube. |
| D | Diameter of fluorescent light tube. FIG. 16 |
| d | Distance between top surface of fluorescent light tube and arc of reflector. FIG. 16. |
| d' | Distance between edges of reflector. FIG. 16 |
| C | Distance from bottom of fluorescent light tube to line extending from edge to edge of reflector. FIG. 16. |
| R | Radius of arc of reflector. FIG. 16. |
| H | Height of reflector. FIG. 16 |
| W | Distance between edges of reflector. FIG. 17. |
| R' | Radius of arc of reflector. FIG. 17. |
| Ht | Height of reflector. FIG. 17. |
| S | Distance from bottom of fluorescent light tube to line extending from edge to edge of reflector. FIG. 17. |
| T | Distance between top surface of fluorescent light tube and arc of reflector. FIG. 17 |

DETAILED DESCRIPTION

The disclosure of this invention includes mounting of a plurality of fluorescent light tubes in a plurality of reflectors mounted in an assembled fixture.

The invention described herein discloses a fluorescent light fixture apparatus having downlight and suspended from the ceiling, and each fluorescent tube light mounted in its own reflector for maximum "down light", and each reflector attached to fluorescent light fixture frame. The fluorescent light fixture apparatus may be for direct downlight or semi-direct, in which case there may be slots in the top surface of the reflectors. (see sec. 12, page 169 in "STANDARD HANDBOOK FOR MECHANICAL ENGINEERS" by BAUMEISTER and MARKS (seventh edition)

The fluorescent light fixture 1, top plan view FIG. 1 apparatus of this invention varies from the prior art, in that in this invention, each fluorescent light tube 3, (FIGS. 2, 5, 6 and 7) in the fixture assembly 1, (FIGS. 6, 7) is mounted in its own light reflector channel 4" (FIGS. 2,3, & 6), on the concave side 4" of the reflector 4 (FIG. 9). The light reflectors 4, are attached to the socket mount/wire raceway arms 6, by anchor rivets,bolts or screws 13, at each end of the light reflector channels 4". Fluorescent fixture tube sockets 5 are mounted in aperture slots 17, for insertion and snap fit of fluorescent tube sockets 5 on the socket mount/wire raceway arms 6 (FIGS. 3, 5,& 6) of assembled fluorescent light fixture apparatus.

Referring now to fluorescent light fixture frame 12 (FIG. 8) showing a plan view of a figure H shape, with arms 6 extending outward and perpendicular to the ends of ballast channel assembly 2. and in each socket mount/wire raceway arm 6, apertures 17 for insertion of snap fit fluorescent fixture tube sockets 5 and 5'. Ballasts 11, for the fluorescent light tubes 3, are mounted in the ballast channel assembly 2 and electric power source 7 into light fixture apparatus 1, and a switch 20 for on/off of the power from the power line 7 to the ballast 11 in the ballast channel assembly 2.

The ballast channel assembly 2, may be likened to a spine, attached to the socket mount/wire raceway arms 6.

FIG. 7 is a perspective view of assembly components of the fluorescent light fixture of this invention, with the light reflectors 4, attached to the socket mount/wire raceway arms 6 by fasteners 19.

FIG. 9 shows isolated light reflectors 4 and apertures 14 for fasteners to attach reflectors to socket mount arms 6.

FIG. 13 shows reflectors having slots 18 in reflectors thus the "light" of the fixtures in addition to having the light go downward the light can also go upwards, but in a lesser amount.

FIG. 14 is a cross-section view of a single fluorescent light fixture, and a single reflector 4, and ballast 11 mounted in ballast mounting channel assembly 22, and showing ballast channel bottom 22' and ballast channel cover 22" fitting over the ballast channel bottom 22'.

FIG. 15 is a perspective view of a single fluorescent light fixture 21, and the ballast 11 mounted in ballast channel assembly 2.

Cross section view of socket mount/wire raceway arm 6 is shown in FIG. 12, and the arms 6 are assembled from bottom section channel of socket mount/wire raceway 6' and top cover channel section of socket mount/wire raceway 6", fitting together lengthwise and held in position by suitable screws or rivets to provide the socket mount/wire raceway arm 6, and wires 16, in arms 6 of fluorescent light fixture frame 12, (see FIG. 8) assembly.

Referring now to FIG. 10, the wiring schematic is shown and the ballasts 11 11' are shown mounted in ballast channel assembly 2, and as shown in FIG. 11, is an assembly of a ballast channel bottom 2', and a ballast channel cover 2" fitting lengthwise over ballast channel bottom 2' and this assembly held together by conventional screws 15.

The electric power source 7 into the light fixture apparatus and on/off switch 20 connected to the power source is shown in FIGS. 1, 3.

The Fluorescent light fixture 1, may hang from a ceiling on hanger wire/chain 10 attached to hanger mounts 8, or to screw mounts 9.

The following is a description of the cross section geometry of light reflectors 4, to insure maximum light reflection downward from the fluorescent light tubes 3. Referring to FIG. 16, wherein it is shown the fluorescent tube 3, having a diameter D, then the radius R of the bend of the reflector 4 is D×0.875, and the arc at the bend of the reflector is equal to 120°, and reflector sides are tangent to the radius at the ends of the arc, and these reflector sides extend outward to a dimension d' equal to 3.25×D, between the edges of the reflector 4, and the distance d between the fluorescent light tube 3 and the arc of the bend of the light reflector is 0.375×D. The distance C is equal to 0.5×D.

Reference is now made to FIG. 17, in which the cross section of reflectors 4 is shown, and the parabola shape compared to FIG. 16, is to reduce the dispersion of light out of the sides of the fluorescent light fixture assembly 1. The reflectors 4 of FIG. 17 are described as the fluorescent light tube 3, having a diameter D, then the radius R'of the bend of the reflector 4 is D×0.875, and the arc at the bend of the reflector is equal to 160°, and the sides of reflector 4, are tangent to the radius at the ends of the arc, and these sides of reflectors 4 extend outward to a dimension W equal to 2×D, between edges of reflector 4 sides. The distance d between the top of fluorescent light tube 3, and the arc of the reflector is equal to 0.375×D.

The distance S, between the bottom of the fluorescent light tube 3, and the line W between the edges of reflector 4, is equal to 0.25×D.

In all of the above description and formulas, the "X", stands for "multiplication" or "times".

Comparing FIGS. 16 and 17, it is readily seen that shortening "W" as shown in FIG. 17 then will focus light downward with less light then extending out of the sides of the fixture assembly 1, thus this invention discloses a method to control light downward in a fluorescent light fixture.

The method of focusing downlight of a fluorescent hanging light fixture 1 by reflectors 4 over each fluorescent light tube 3, a reflector 4 extending the length of the fluorescent light tube 4, and the cross section of the reflector 4, is an arc straddling the fluorescent light tube 3 and a space of 0.375 times diameter of the fluorescent light tube 3 from the fluorescent light tube 3 and the arc of the reflector 4 having a radius of 0.875 times the diameter of the fluorescent light tube 3 and the arc ranging from 120° to 160° and the sides of the reflector 4, tangent at each end of arc range of reflector 4.

The reflector 4, of this invention may be of polished sheet metal or metal coated plastic, or metal coated glass.

Having described my invention I claim:

1. Fluorescent light fixture comprising;

a—longitudinal light reflectors and each end of said longitudinal light reflectors attached to socket mount/wire raceway arms, b—said socket mount/wire raceway arms attached to ends of ballast channel assembly, c—light tube sockets for fluorescent light tubes mounted on said socket mount/wire raceway arms at each end of said longitudinal light reflectors in the concave side of said longitudinal light reflectors and d—said fluorescent light tubes inserted into said light tube sockets in the concave side of said longitudinal light reflectors.

2. Fluorescent light fixture of claim 1, further consisting of;

a—a plurality of said longitudinal light reflectors and each end of said longitudinal light reflectors attached to said socket mount/wire raceway arms and, b—two of said socket mount/wire raceway arms attached one on each end perpendicular to ends of said ballast channel assembly, c—said light tube sockets for said plurality of fluorescent light tubes mounted on said socket mount/wire raceway arms at each end of said plurality of longitudinal light reflectors in the concave side of said plurality of longitudinal light reflectors, d—said plurality of fluorescent light tubes inserted into said light tube sockets in said concave side of said light reflectors, e—slots in said longitudinal light reflectors for indirect lighting and f—suspending, by hanger wire/chain, said fluorescent light fixture from a ceiling.

3. Longitudinal light reflectors, of claim 1, selected from the group consisting of polished sheet metal, metal coated plastic, and metal coated glass.

4. A method of focusing downlight of a fluorescent hanging light fixture consisting of;

a—longitudinal light reflectors over each fluorescent light tube, b—said longitudinal light reflector extending the length of said fluorescent light tube c—cross section of said longitudinal light reflectors comprising an arc straddling said fluorescent light tube and at a space of 0.375 times diameter of said fluorescent light tube from said fluorescent light tube d—said arc of said longitudinal light reflector having a radius of 0.875 times the diameter of said fluorescent light tube and said arc ranging from 120° to 160° and e—sides of said longitudinal light reflector tangent at each end of said arc range of said reflector.

5. Fluorescent light fixture consisting of;

a—longitudinal light reflectors, and each end of said longitudinal light reflectors attached to socket mount/wire raceway arms, b—said socket mount/wire raceway arms attached to ends of ballast channel assembly, c—light tube sockets for fluorescent light tubes mounted on said socket mount/wire raceway arms at each end of said longitudinal light reflectors in the concave side of said longitudinal light reflectors and d—said fluorescent light tubes inserted into said light tube sockets in the concave side of said longitudinal light reflectors, e—a plurality of said longitudinal light reflectors and each end of said longitudinal light reflectors attached to said socket mount/wire raceway arms, f—two of said socket mount/wire raceway arms attached one on each end perpendicular to ends of said ballast channel assembly, g—said light tube sockets for a plurality of said fluorescent light tubes mounted on said socket mount/wire raceway arms at each end of said plurality of longitudinal light reflectors in the concave side of said plurality of longitudinal light reflectors, h—said plurality of fluorescent light tubes inserted into said light tube sockets in said concave side of said longitudinal light reflectors, i—slots in said longitudinal light reflectors for indirect lighting and, j—suspending, by hanger wire/chain, assembly of said fluorescent light fixture.

* * * * *